US009345277B2

(12) United States Patent
Albera

(10) Patent No.: US 9,345,277 B2
(45) Date of Patent: May 24, 2016

(54) PROTECTIVE HAND OR FOOT SHIELD

(71) Applicant: Renee Albera, Atherton, CA (US)

(72) Inventor: Renee Albera, Atherton, CA (US)

( * ) Notice: Subject to any disclaimer, the term of this patent is extended or adjusted under 35 U.S.C. 154(b) by 245 days.

(21) Appl. No.: 14/049,520

(22) Filed: Oct. 9, 2013

(65) Prior Publication Data

US 2014/0325728 A1 Nov. 6, 2014

Related U.S. Application Data

(60) Provisional application No. 61/819,834, filed on May 6, 2013.

(51) Int. Cl.

*A45D 29/00* (2006.01)
*A41D 13/08* (2006.01)
*A41D 13/06* (2006.01)

(52) U.S. Cl.

CPC ..... *A41D 13/06* (2013.01); *A41D 13/081* (2013.01); *A45D 29/00* (2013.01)

(58) Field of Classification Search

CPC ... A41D 13/08; A41D 13/081; A41D 13/085; A41D 13/087
USPC ..... 2/23, 16, 21
See application file for complete search history.

(56) References Cited

U.S. PATENT DOCUMENTS 2,227,825 A 1/1941 Devermann
2,725,570 A * 12/1955 Penna ..... 2/163
3,409,010 A 11/1968 Kron
5,014,362 A 5/1991 Tillotson et al.
5,125,115 A 6/1992 Lincoln
5,598,584 A 2/1997 Da Grossa
5,623,734 A 4/1997 Pugliatti
5,799,331 A 9/1998 Stewart
6,026,513 A 2/2000 Sima
6,272,688 B1 * 8/2001 Wilson ..... 2/170
6,539,550 B1 * 4/2003 Flores ..... 2/16
6,578,205 B1 * 6/2003 King ..... 2/161.7
6,952,838 B1 10/2005 Gillette
2004/0123370 A1 7/2004 Polesuk
2010/0024088 A1 * 2/2010 Griefer ..... 2/16
2010/0088804 A1 4/2010 Crosby
2012/0047624 A1 3/2012 Hubsmith
2013/0198921 A1 8/2013 Plumer
2013/0341536 A1 * 12/2013 Mercado et al. ..... 250/516.1

* cited by examiner

*Primary Examiner* — Robert J Hicks
*Assistant Examiner* — Timothy K Trieu
(74) *Attorney, Agent, or Firm* — Welsh Flaxman & Gitler LLC

(57) ABSTRACT

A protective shield for protecting a user's hands or feet from harmful ultraviolet rays when a coating composition applied to the user's fingernails or toenails during a manicure or pedicure is cured by an ultraviolet curing system. The protective shield includes a thin elastomeric or polymeric sheet of material impregnated with an ultraviolet blocking composition. The protective shield is provided with five or more slits, allowing the ends of the user's digits to be inserted through separate slits, ensuring that only the user's fingernails or toenails would be subjected to the ultraviolet rays produced by the ultraviolet curing system, while protecting the user's hands or feet from the ultraviolet rays. The protective shield is designed to cover a user's hand or foot while allowing the user's fingernails or toenails to protrude from separate slits provided near the end of the shield, while the slits rest firmly under the cuticles of the user's fingernails or toenails.

14 Claims, 6 Drawing Sheets

PROTECTIVE HAND OR FOOT SHIELD

CROSS-REFERENCE TO APPLICATION

The present application claims the benefit of U.S. Provisional Patent Application Ser. No. 61/819,834, entitled "PROTECTIVE HAND OR FOOT SHIELD," filed on May 6, 2013, and is incorporated herein by reference.

BACKGROUND OF THE INVENTION

1. Field of the Invention

The present invention is directed to a shield for protecting the hand or foot of a user from ultraviolet light emitted from an ultraviolet light curing system, such as ultraviolet nail lamps or light-emitting diode (LED) ultraviolet gel nail lamps during the curing of nail polish, nail gel, shellac nail polish or any coating composition applied to the fingernails or toenails during manicures or pedicures requiring UV curing.

2. Description of the Related Art

When a gel-type polish, that is a nail coating composition that requires UV light to cure, is applied during manicure or pedicure, it is necessary for the polish to be cured under an ultraviolet gel curing system, such as an ultraviolet gel nail lamp or a LED ultraviolet gel nail lamp for possibly 30 seconds to 3 minutes per application of the coating composition. Based upon the time and the number of applications of coating composition applied during a UV gel manicure and pedicure, users of gel-type polish can be subjected to up to 12 minutes of unprotected exposure to ultraviolet light. This exposure of the user could have many deleterious effects on the user, such as premature aging of the skin and/or the production of sun or liver spots. Additionally, ultraviolet light has been implicated as a carcinogen. Therefore, it is imperative that the hands and feet of the user, with the exception of the fingernails or toenails, be protected from unnecessary exposure to ultraviolet light during the curing of the coating composition applied to the fingernails or toenails during manicures and pedicures.

It should be appreciated the recitation of the term "ultraviolet gel curing system," and variations thereof, as used throughout the present disclosure, refers to any system, such as an ultraviolet gel nail lamp or a LED ultraviolet gel nail lamp for curing any coating composition, such as, but not limited to nail polish, shellac or nail gel polish applied to the fingernails or toenails during a manicure or pedicure.

U.S. Pat. No. 6,026,513 to Sima illustrates a fingerless manicure glove including a main portion for accommodating the palm of the hand, as well as a plurality of finger portions. Each of the distal portions of the finger portions defines an opening allowing the fingernail of the finger to protrude from the opening. It is noted the purpose of this fingerless glove is to insulate the wearer's hand from inclement weather while the nails are being exposed to the cold to rapidly cure the nail polish applied to the client's nails. Therefore, the Sima reference is directed to a curing process different from using ultraviolet light rays to cure a product applied to the nails during a manicure or pedicure. The Sima glove is designed to keep the wearer's hands warm while the nail polish is being cured by its exposure to cold temperatures. Gel nail polish and/or the variations listed previously of this product, can only be cured using the ultraviolet light, thus Sima's described method of curing is completely opposite of the one the shield is intended to protect the hand for. Additionally, the finger portions of the Sima glove do not "grip" the finger in any specific way, making it difficult for the glove's finger portions to stay in one place, something that is important when curing the nails under the UV light because the hand is being moved into and out of the gel curing system 1 to 5 times, thus the protection on the hand needs to stay in one place in order to protect as much of the skin of the user as possible and to insure the glove or shield does not interfere with the product applied before it is completely cured. The shield's material stays under the cuticle due to the tensile strength of said material, thus not interfering with the polish and/or exposing too much of the skin on the finger. Additionally, the Sima glove is designed to cover the palm and the top of the hand of the user. Furthermore, the Sima glove is fabricated from a piece of stretchable fabric designed to be washed after each use and brought back to the salon for use on the customer's next visit, something which is often difficult for the customer to remember to do while the shield, being disposable and inexpensive to manufacture, will be available at the nail salon.

U.S. Pat. No. 5,598,584 to Da Grossa describes a fingernail glove covering the palm, the top of the hand and the fingers of the user with the exception of the fingernails of the user. The primary purpose of this prior art is to keep the wearer's hands warm while simultaneously exposing the nails of the wearer. This prior art exposes the nails for the purpose of a women to show off her nails. The fingernail glove is designed to be made of a stretchable fabric and is not intended to protect a woman's hand from ultraviolet light rays.

U.S. Pat. No. 6,539,550 to Flores describes a set of three driving gloves. Each of the gloves is available in varying lengths to cover as much of the user's arm, wrist and a portion of the hand, as necessary depending on the clothing of the user. The glove features finger portions cut away, thus exposing a large amount of the fingers of the user, which is done to allow greater flexibility of the fingers when driving. These gloves are produced from a lightweight material that protects primarily the user's skin on the wrist, a large portion of the exposed arm and a smaller portion of the hand of the user from the ultraviolet light emitted from the sun. This prior art cannot be used to protect the feet of the user, nor would it be practical to use during the curing of a gel manicure due to the large amount of skin allowed to be exposed on the fingers in order to insure the flexibility of the user's fingers during driving.

U.S. Pat. No. 5,799,331 to Stewart depicts a disposable hand protector intended to create a barrier between an item, such as food or medical devices and the hand of an individual to prevent the contamination of the food or the medical devices. In this particular prior art example, the entire hand of the individual, including the tips of the individual's fingers and fingernails are covered. Furthermore, the Steward hand protector does not block the hands of the user from ultraviolet light.

U.S. Pat. No. 3,409,010 to Kron describes a disposable half-glove/mitt intended to be used to clean surfaces of a patient, to apply medications, ointments, etc., to a patient or to protect the user's hand from whatever is being applied or wiped off of a patient. The mitt/glove covers the user's fingers and fingernails and a portion of the top and the bottom of the hand of the user. This mitt/glove is made of disposable material that does not provide any protection from ultraviolet light, nor does it expose the fingernails, nor cover the entire top of the hand, nor can it be used to protect the skin on the foot.

U.S. Pat. No. 5,623,734 to Pugliatti illustrates a pedicure sock intended to keep a user's foot warm during a conventional pedicure. A number of separate stalls are provided at the end of the sock allowing the wearer's toes to protrude from the end of said sock, therefore enabling a conventional pedicure to be performed, using nail polish that does not need to be cured under a UV gel system, to be placed on the toenails. However, the Pugliatti sock does not protect the wearer's feet and ankles from ultraviolet rays, it is made of a material intended to be washed and used again and it does not cover the entire toe of the user up to the cuticle.

Therefore, none of the above noted U.S. patents describe a single shield adapted for use to protect either a hand or a foot of a user during a manicure or a pedicure that must be cured under a UV gel system. That is, none of the above noted United States patents describe a shield having slits provided to expose the fingernails and/or the toenails of the user, while coveting the hand and a portion of the wrist and the foot and a portion of the ankle of the user while the application(s) of a gel polish or a facsimile thereof, is cured under a UV gel system.

SUMMARY OF THE INVENTION

It is, therefore, an object of the present invention to overcome the aforementioned problems of the prior art by providing a single shield to be used to cover the top of the hand or the top of the foot of a user during a manicure or pedicure.

A further object of the present invention is to provide a shield for the protection of the user's hand and a portion of the wrist or a user's foot and a portion of the ankle.

Yet another object of the present invention is to provide an easy to manufacture shield for the protection of the user's hand or foot during the curing of a gel-type manicure or pedicure.

A further object of the present invention is to provide a single shield capable of selective application to the user's left hand, right hand, left foot or right foot to protect the user from harmful ultraviolet light rays during the curing process associated with a gel-type manicure or a pedicure. Alternatively, shields similar to one another in shape and construction can be simultaneously applied to various combinations of the user's hands and feet during the curing process associated with a gel-type manicure or pedicure.

The present invention overcomes the deficiencies of the prior art by providing a single shield to be used to protect either the user's left hand, right hand, left foot or right foot from ultraviolet rays when the user is receiving a UV cured manicure or pedicure.

With regard to the present invention the shield comprises a single, thin sheet of elastomeric material containing Titanium Dioxide for UV protection thereby protecting the individual user from all, or a significant amount, of ultraviolet rays produced by the ultraviolet gel curing system. The sheet is opaque which further assists in blocking UV rays. However, regardless of the composition of the sheet, the sheet must block all, or a significant amount, of ultraviolet radiation directed at the sheet. The shield overlies the top of the user's hand or the top of the user's foot and does not contact the bottom of the user's hand or the bottom of the user's foot. The shield includes at least five slits provided near the distal end of the shield. When used for a manicure, each of the slits is provided at a particular location on the shield enabling the ends of the user's fingers, as well as the end of the thumb, to be inserted through one of the slits, while the top of the hand is covered by the shield with only the user's fingernails or thumbnail exposed to the ultraviolet light used in the gel curing system. Similarly, when used for a pedicure, the shield covers the top of the user's foot with the exception of the user's toenails. The toenails remain uncovered by inserting the ends of each of the user's toes through one of the slits, enabling the coating composition applied to the toenails to be cured when the user's feet are inserted into an ultraviolet gel curing system.

The slits are situated in such a manner to allow a single manufactured shield with a single slit pattern to be alternatively utilized on the user's left hand, right hand, left foot or right foot during the curing process. Alternatively, shields similar to one another in shape and construction can be simultaneously applied to various combinations of the user's hands and feet during the curing process. It is important to note that the same shield with a single slit pattern of the present invention has been designed to be applied to the user's left hand, right hand, left foot or right foot, while allowing the user's fingernails or toenails to be exposed to the curing process.

It is appreciated the shield can be manufactured in various sizes, such as small, medium and large to accommodate different sized hands or feet, as well as manufactured in different shapes based upon the nail fashion at the time of production. Furthermore, and based upon the tensile strength of the material used to produce the shield, a significant amount of leeway or pull of the material would allow only a single sized shield to be used for virtually any sized hand or foot. Additionally, the shield is relatively inexpensive to produce and, therefore, is disposable.

The shield of the present invention additionally differs from the prior art due to the placement of a portion of the shield directly below the cuticle of the user. The composition of the material used to produce the shield enables the shield to be very stretchable. When the user places each finger or toe through one of the slits, due to the elasticity of the shield, a portion of one of the slits of the shield is placed under each cuticle, thereby covering a maximum amount of skin during the curing process. Additionally, the stretchable nature of the slits allows the shield to accommodate almost all sizes and shapes of fingers and toes. Once the slits are placed underneath the cuticles of the fingernails or toenails of the user, after the fingernails or toenails extend through the slits, the rest of the shield's overall fit is adjusted to cover the top of the hand or foot of the user and optionally a portion of the user's wrist and ankle accordingly.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

Figure 1:
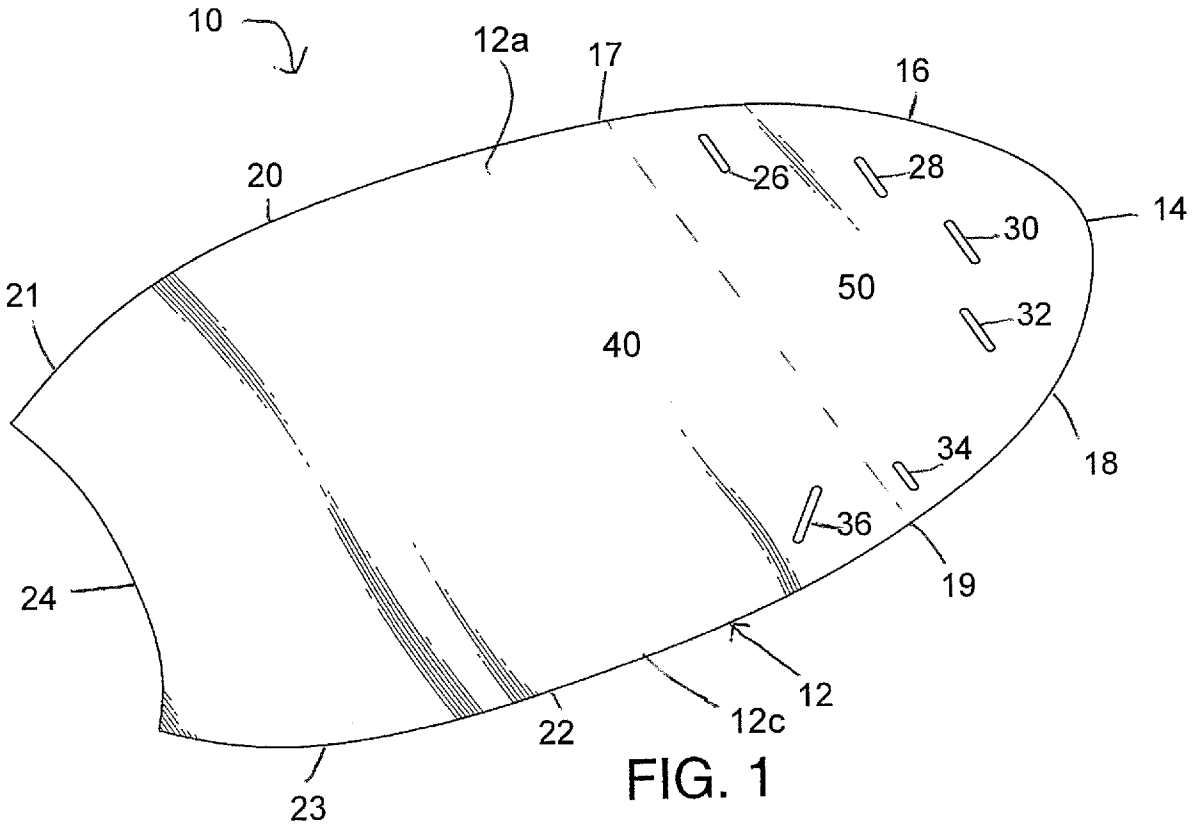
FIG. 1 is a perspective view of a preferred embodiment of the shield.
Figure 4:
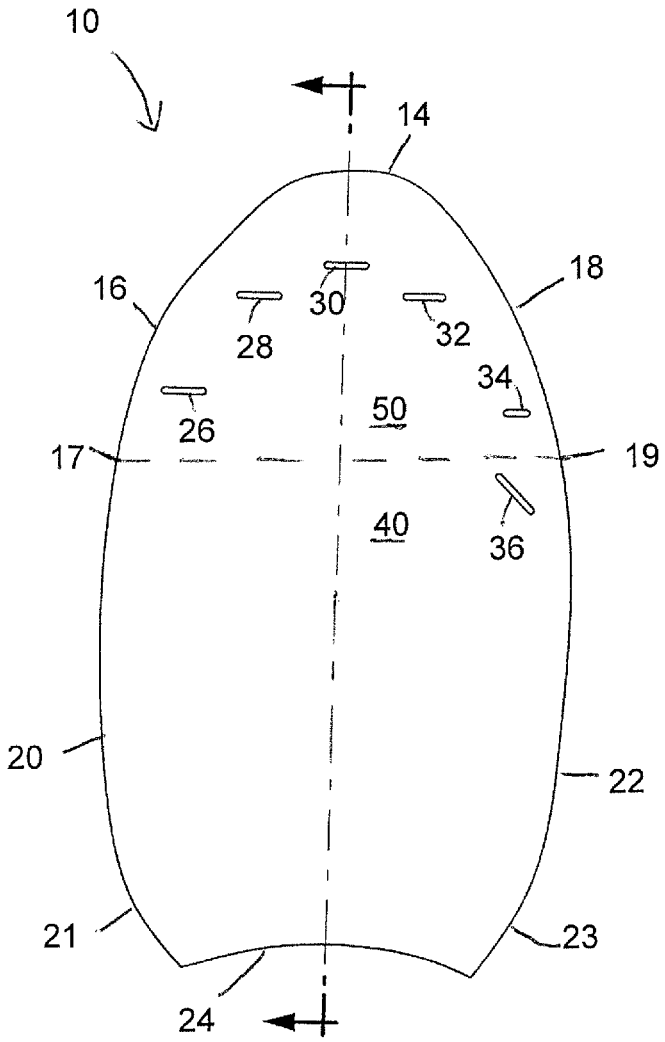
FIG. 4 is a top view showing the preferred embodiment of the shield.
Figure 5:
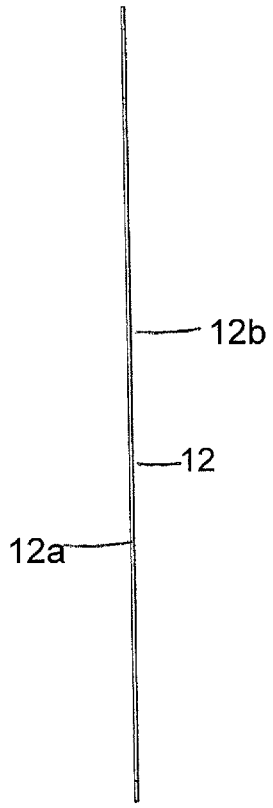
FIG. 5 is a side view of the preferred embodiment of the shield taken through 4-4 of FIG. 4.

The shield 10 of the present invention, as shown in FIGS. 1, 4 and 5 comprises a thin polymer or elastomeric planar sheet of material 12 impregnated with a composition blocking all, or a significant amount, of ultraviolet radiation, particularly the ultraviolet radiation produced by the ultraviolet gel curing system used to cure a coating composition applied to the user's fingernails or toenails during a manicure or pedicure, from reaching the hand or the foot of the user during curing by the ultraviolet gel curing system. The coating composition applied to the fingernails or the toenails would include gel-type nail polish, or any other product applied to the nails requiring UV curing.

A preferred embodiment of this invention is shown in FIGS. 1-6. As shown in FIGS. 1 and 4, the sheet 12 includes an upper surface 12*a* and a lower surface 12*b* with a peripheral edge 12*c* defining the outer edge of the sheet 12. In accordance with a preferred embodiment, the peripheral edge of the sheet 12 takes the form of a fingernail. With this in mind, the peripheral edge 12*c* of the sheet 12 includes first and second arcuate (or rounded) arms 16, 18 that meet at an apex 14, as well as first and second edge portions 20, 22 that are connected by a bottom edge portion 24.

Each of the first and second arcuate arms 16, 18 includes a first end 16*a*, 18*a* and a second end 16*b*, 18*b*. The first ends 16*a*, 18*a* meet at the apex 14, while the second ends 16*b*, 18*b* respectively end at points 17, 19 positioned on opposite sides of the sheet 12.

Extending from the point 17 to the curved bottom edge portion 24 of the sheet 12 is the first side edge portion 20. The side edge portion 20 is relatively straight until it begins to curve at point 21 close to the bottom edge portion 24. The second side edge portion 22 extends from point 19 to the bottom edge portion 24 of the shield 10. The second side edge portion 22 is relatively straight until it begins to curve at a point 23 close to the bottom edge portion 24.

The sheet 12 may further be thought of as including a distal section 50 and a proximal section 40, wherein the distal section 50 includes that portion of the sheet 12 encompassed by first and second arcuate arms 16, 18 and a straight line extending from point 17 to point 19. With this in mind, the proximal section 40 is defined by the straight line extending from point 17 to point 19, the first side edge portion 20, the second side edge portion 22 and the bottom edge portion 24.

Five slits 26, 28, 30, 32, 34 are provided in the distal section 50 of the sheet 12, that is, above the imaginary line (shown in broken lines) connecting points 17 and 19 together. A sixth slit 36 is included in a proximal section 40 of the sheet 12 that is, below the imaginary line connecting points 17 and 19 together. Each of the slits 26, 28, 30, 32, 34, 36 extends completely through the sheet 12, allowing the fingernails or toenails of the user to completely protrude from the sheet 12 as the slits can be elastically stretched. Each of the slits 26, 28, 30, 32, 34, 36 is spaced from the peripheral edge 12*c* of the sheet and none of the slits 26, 28, 30, 32, 34, 36 extend to the peripheral edge 12*c* of the sheet 12.

The sheet 12 is elastic, thereby allowing the length and the width of each slit 26, 28, 30, 32, 34, 36 to be temporarily elongated (i.e., stretched), enabling the ends of differently sized digits to be inserted through each of the respective slit 26, 28, 30, 32, 34, 36. The term "digits" is used to refer to a user's thumb, fingers and/or toes. Due to the elastomeric property of the material of sheet 12, the slits 26, 28, 30, 32, 34, 36 have the ability to stretch and then contract about a user's digits such that the shield 10 is held in place by the respective slits 26, 28, 30, 32, 34, 36 cooperating with the user's digits. That is, the shield 10 is frictionally retained in place by the slits 26, 28, 30, 32, 34, 36 stretching to fit about the user's digits just below his or her cuticles. Once the end of a particular digit has been inserted through one of the slits 26, 28, 30, 32, 34, 36, the length and width of that slit 26, 28, 30, 32, 34, 36 attempts to return to its initial state, thereby securing the slit 26, 28, 30, 32, 34, 36 about a user's digit. Additionally, as particularly shown in FIGS. 2A, 2B, 3 and 6, a portion of the surface of the sheet 12 is provided under the cuticles of the user's fingernails or toenails after the ends of the fingers or toes are inserted into their respective slit 26, 28, 30, 32, 34, 36. Furthermore, and as briefly discussed above, the slits 26, 28, 30, 32, 34, 36 are spaced from the peripheral edge 12*c* of the sheet and the shield 10 includes material extending beyond the inserted toenails or fingernails to the peripheral edge 12*c* of the sheet 12 and to the apex 14 of the sheet 12.

Figure 2A:
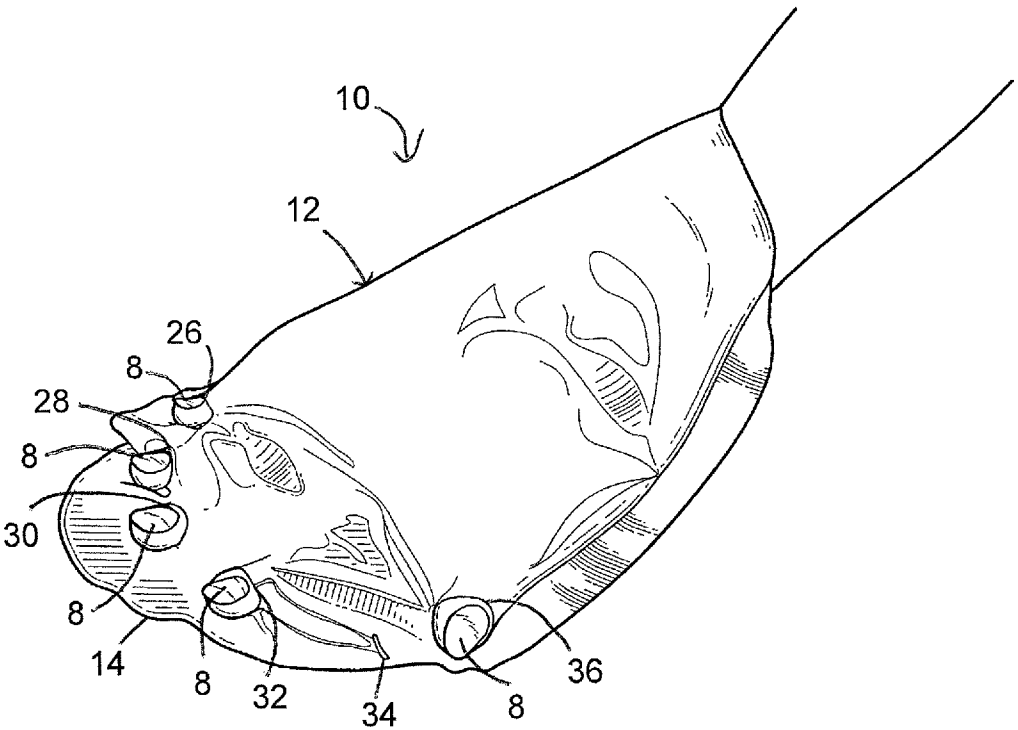
FIG. 2A is a perspective view showing the preferred embodiment of the shield on the right hand of the user.
Figure 2B:
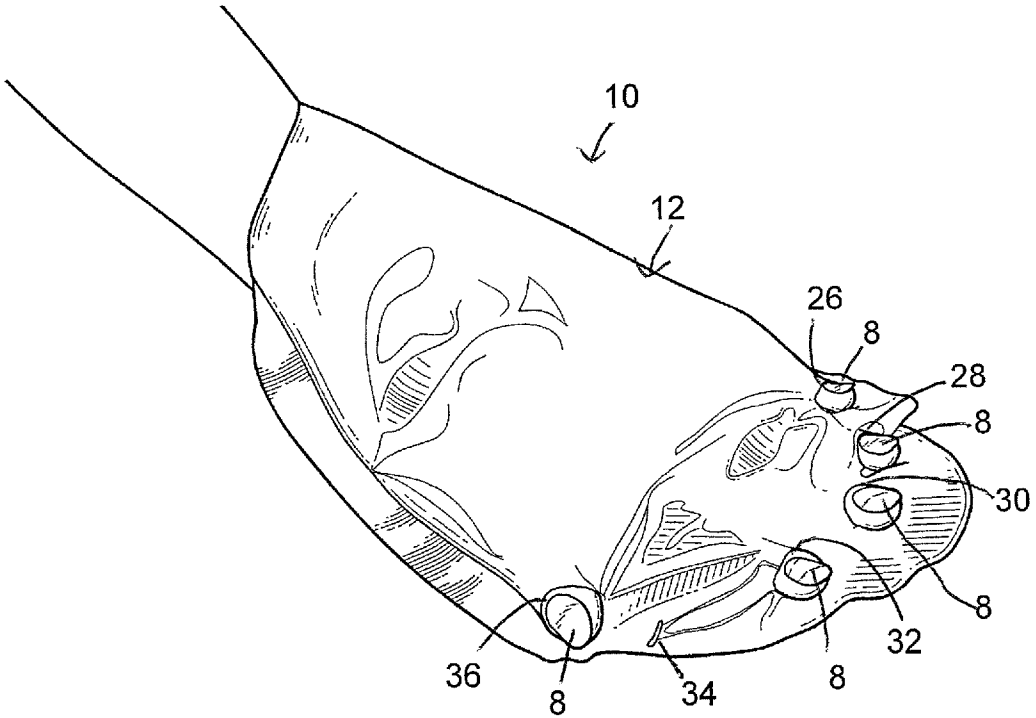
FIG. 2B is a perspective view showing the preferred embodiment of the shield on the left hand of the user.
Figure 6:
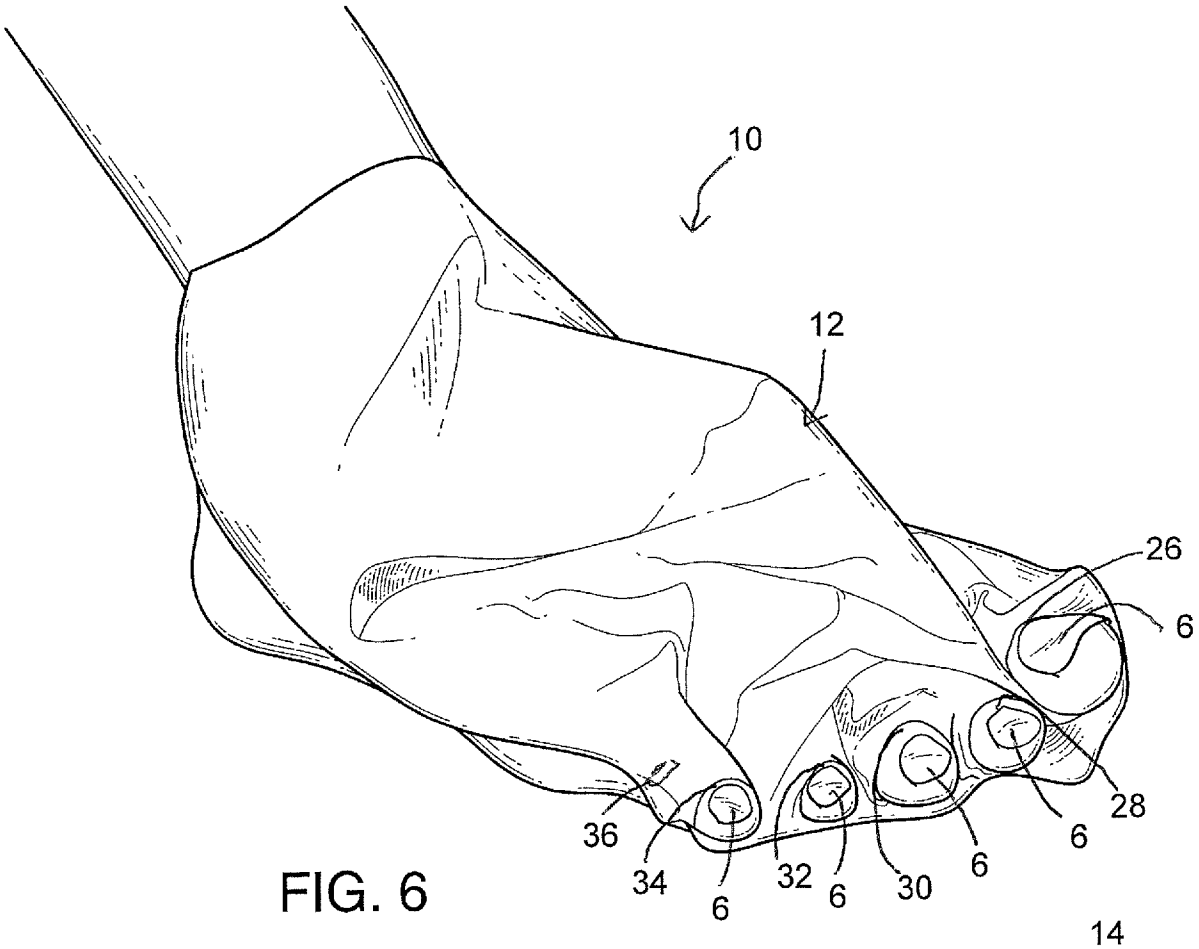
FIG. 6 is a perspective view showing the preferred embodiment of the shield on the right foot of the user.

The present invention includes six slits 26, 28, 30, 32, 34, 36. The number and positioning of the slits allows the same shield 10 to be applied over the right hand, as shown in FIG. 2A and the left hand as shown in FIG. 2B by simply turning the shield 10 over. Similarly, the same shield 10 illustrated in FIGS. 2A and 2B can be applied to the top of the right foot of the user as shown in FIG. 6. Additionally, although not shown in the drawings, turning over the shield 10 shown in FIG. 6, the shield 10 can be applied to the left foot of the user. Due to the spacing of the toes versus the fingers, the top portion of the shield 10 near the apex 14 (that is, the distal section 50) is bunched together during use to accommodate the toes of the user. When the shield 10 shown in FIG. 6 is turned over, the shield 10 can be applied to the top of the left foot, with the distal section 50 of the shield 10 near the apex 14 also bunched to accommodate the toes of the user. The inclusion of six slits 26, 28, 30, 32, 34, 36 allows a single shield 10 to better accommodate the physicality of the user's fingers and toes to be inserted into the appropriate slits 26, 28, 30, 32, 34, 36, ensuring that the user's fingernails or toenails would not be covered by the sheet 12 of the shield 10.

As previously indicated, the shape of the shield 10, as illustrated in FIG. 1, could be in the form of a fingernail. However, it is appreciated the sheet 12 can take many forms and shapes and still function to protect the top of the user's hands and feet. What is important is that the sheet 12 covers the top of the user's hand including the user's fingers and extend to, and preferably slightly beyond the user's wrist as illustrated in FIGS. 2A and 2B. Similarly, when used to protect the user's feet, the sheet 12 covers the top of the user's foot and extends to, and preferably slightly beyond, the user's ankle as shown in FIG. 6.

As previously described, the sheet 12 is constructed from an elastomeric or polymeric sheet of material, which blocks the ultraviolet rays from contacting the top of the user's feet or the top of the user's hand, with the exception of the user's toenails or fingernails. The sheet 12 can contain titanium dioxide to provide opacity and a white color along with several additives. Titanium dioxide is an ultraviolet blocking agent and is provided in such products as paint and sunscreen. Instead of titanium dioxide, the sheet could be impregnated or contain other ultraviolet blocking agents such as nitrile. The sheet 12 is very flexible and has thickness between 2 mils and 6 mils, preferably 3 mils. The sheet 12 exhibits 8000 psi ultimate tensile strength and a 900% elongation at break. The sheet 12 can also be constructed from silicon rubber, a thermoplastic elastomeric material, rubber polyurethane, silicon or a thin polyethylene material.

FIGS. 2A and 2B illustrate the use of the shield 10 shown in FIG. 1 covering the top of the right hand of the user as shown in FIG. 2A, as well as the top of the left hand of the user shown in FIG. 2B when the shield 10 is turned over. In both FIGS. 2A and 2B, each of the user's fingernails 8 extends through slits 26, 28, 30, 32 and 36, while protecting the fingers, the top of the user's hand and the wrist from the ultraviolet light rays produced by the ultraviolet gel curing system. As shown in FIGS. 2A and 2B, none of the user's fingernails extend through slit 34.

FIG. 6 illustrates the use of the shield 10 shown in FIGS. 1, 4 and 5 applied to the top of the right foot of the user. As can be appreciated, although not shown in the drawings, the same shield 10 covering the right foot of the user as shown in FIG. 6 can be turned over to cover the left foot of the user. FIG. 6 shows that each of the user's toenails 6 extends through slits 26, 28, 30, 32 and 34 shown in FIGS. 1 and 4, while protecting the toes, the top of the user's foot and the user's ankle from the ultraviolet rays produced by the ultraviolet gel curing system. However, none of the user's left or right toenails extend through the slit 36. Due to the physiology of the user's foot, the top surface of the sheet 12 close to the apex 14 in distal section 50 located between the rounded arms 16 and 18 is bunched together. This would not be the case for the embodiment shown in FIGS. 2A and 2B which covers the top of the hands of the user.

The slits 26, 28, 30, 32, 34, 36, shown in FIG. 1 without the shield 10 applied to the user's hands and lying flat, are provided and oriented in an arcuate pattern mimicking the fingertip pattern of a user's hand when it is laid flat upon a supporting surface. Slits 26, 28, 30, 32 and 34 are situated in the distal section 50 of the sheet 12 above the imaginary line connecting points 17 and 19. The remaining slit 36 is located slightly below the imaginary line connecting points 17 and 19 in proximal section 40 and continues the arcuate pattern of the slits 26, 28, 30, 32, 34 in the distal section 50. Because of the differing geometry of feet and hands, the slits 26, 28, 30, 32, 34 of the distal section 50 are aligned differently from slit 36 in the proximal section 40. In particular, the slits 26, 28, 30, 32, 34 in the distal section 50 each have a longitudinal axis and each of the longitudinal axes is parallel to one another, which the slit 36 in the proximal section 40 includes a longitudinal axis that is oblique relative to the longitudinal axes of the slits 26, 28, 30, 32, 34 in the distal section 50.

When in use, with the shield 10 applied to the right hand of the user as shown in FIG. 2A, the user's thumb is inserted through slit 36. The end of the user's index finger is inserted through slit 32 and the end of the user's middle finger is inserted though slit 30. Additionally, the end of the user's ring finger is inserted through slit 28, and the end of the user's pinkie is inserted through slit 26. As depicted in FIG. 2A, none of the user's fingers would be inserted through slit 34.

FIG. 2B shows the sheet 12 being applied to the user's left hand after the sheet shown in FIG. 2A has been turned over. When in use, the user's thumb is inserted through slit 36. The end of the user's index finger is inserted through slit 32 and the end of the user's middle finger is inserted through slit 30. Additionally, the end of the user's ring finger is inserted through slit 28 and the end of the user's pinkie is inserted through slit 26. As shown in FIG. 2B, none of the user's fingers are inserted through slit 34.

FIG. 6 illustrates the ends of the toes of the left foot inserted through the slits 26, 28, 30, 32 and 34. Although not shown in the drawings, when the shield 10 as shown in FIG. 6 is turned over, the ends of the toes of the right foot would also be separately inserted through the slits 26, 28, 30, 32 and 34. In both situations, none of the ends of the toes are inserted through slit 36. As shown in FIG. 6 the bunching of the sheet 12 adjacent the apex 14 in the distal section 50 causes the slits 26, 28, 30, 32 and 34 to move into a relatively straight line from the arcuate as shown in FIGS. 2A and 2B when the sheet is flat. That is, the slits 26, 28, 30, 32 and 34 form a relatively straight line, with slit 36 offset from the slits 26, 28, 30, 32 and 34. This bunching of the sheet 12 close to the apex 14 in distal section 50 is created by the differences in the physiology of the toes of the foot of the user when compared to the fingers of the user. Additionally, slits 26, 28, 30, 32 and 34 are located in the distal section 50, with slit 36 situated slightly below the imaginary line connecting points 17 and 19 in proximal section 40. When in use, the end of the big toe 6 of the user is inserted through slit 26, and the end of the index toe of the user is inserted through slit 28. The end of the middle toe of the user is inserted through slit 30. The end of the fourth toe of the user is inserted through slit 32 and the end of the pinkie toe of the user is inserted through slit 34. It is important to note that none of the toes of the user would be inserted through slit 36.

As previously indicated, different sizes of the sheet 12 of the shield 10 can be manufactured to accommodate small, medium and large hands and feet. The sizes and shapes of the sheet 12 of the shield 10 may differ based upon the nail fashion at the time of the manufacture of the sheet 12 of the shield 10. While FIGS. 1 and 4 illustrate the sheet 12 of the shield 10 shaped as a fingernail, virtually any shape of the sheet 12 can be employed. The length of each of the slits 26, 28, 30, 32, 34, 36 is in the range of 1.52 mm and 15.875 mm. Additionally, the distance between slit 26 and slit 28 is in the range of 20.2 mm to 24.2 mm. The distance between slit 28 and slit 30 is in the range of 10.7 mm to 14.7 mm. The distance between slit 30 and slit 32 is in the range of 13.875 mm to 17.875 mm. The distance between slit 32 and slit 34 is in the range of 23.4 mm to 27.4 mm. The distance between slit 34 and slit 36 is in the range of 48.8 mm and 52.8 mm.

Figure 3:
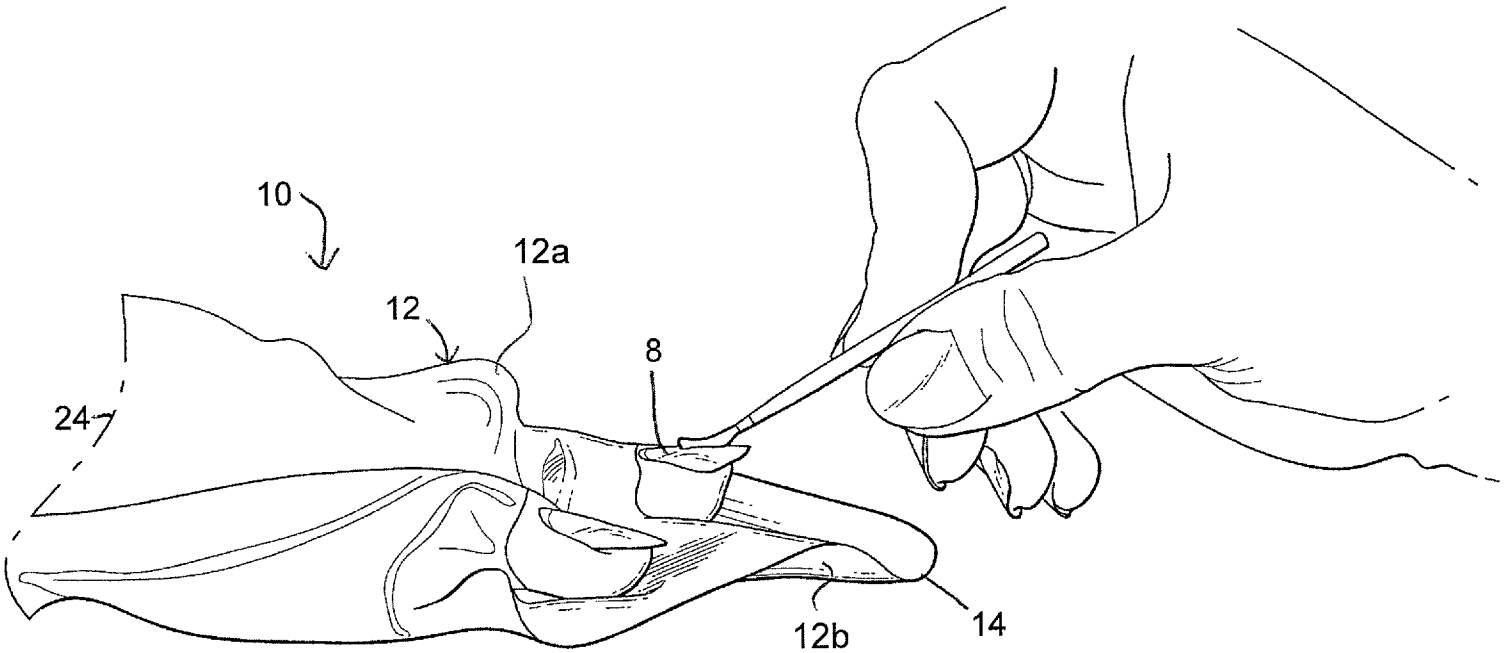
FIG. 3 is a side view of the shield showing a nail coating composition being applied to one hand of the user.

FIG. 3 illustrates the shield 10 covering the top of one of the user's hands. The manicurist would easily be able to coat the fingernails or toenails of the user with the shield 10 in place. Once all of the user's nails are covered with the coating composition, the user would proceed to the curing station at which time ultraviolet rays would be directed toward the user's hands and/or feet by the ultraviolet gel curing system. The shield 10 would protect the tops of the user's hands and/or feet from the harmful ultraviolet rays, while allowing the coating composition applied to the surface of the nails to be cured.

As previously described, a single shield 10 can be used to cover and protect the right hand, left hand, right foot and left foot of the user while allowing the user's fingernails or toenails to extend through the slits during the curing process of a manicure or pedicure.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A shield for protecting a user's hand or foot, wherein the hand or foot includes digits and each digit includes a nail, during a UV light curing manicure or pedicure, comprising: a planar sheet having an upper surface, a lower surface and a peripheral edge, the planar sheet being composed of an elastic material including a composition preventing ultraviolet light rays from traveling through the planar sheet; the planar sheet including a plurality of slits formed in the planar sheet, each of the plurality of slits extending through the upper surface and the lower surface of the planar sheet and spaced away from the peripheral edge of the planar sheet; and adapted each of the plurality of slits having a length and width to elastically stretch about the user's digits to expose the nails of the user's digits when attaching the planar sheet to the user's hand or foot so as to cover the hand or foot while exposing only the nails of the user's digits.

2. The shield in accordance with claim 1, wherein the composition is titanium dioxide.

3. The shield in accordance with claim 1, wherein the planar sheet has a distal section and the plurality of slits includes five slits in an arcuate pattern across the distal section of the planar sheet.

4. The shield in accordance with claim 3, wherein the planar sheet has a proximal section and the plurality of slits includes one slit in the proximal section of the planar sheet.

5. The shield in accordance with claim 4, wherein the one slit in the proximal section continues the arcuate pattern of the five slits of the distal section.

6. The shield in accordance with claim 4, wherein the five slits in the distal section each have a longitudinal axis and the longitudinal axes of the five slits are parallel to one another, and the one slit in the proximal section includes a longitudinal axis that is oblique relative to the longitudinal axes of the five slits in the distal section.

7. The shield in accordance with claim 1, wherein the planar sheet is sized to cover at least a portion of the user's wrist or ankle when the shield is attached to the user's digits.

8. The shield in accordance of claim 1, wherein the planar sheet is opaque.

9. The shield in accordance with claim 1, wherein the plurality of slits includes six slits.

10. A shield for protecting a user's hand or foot, wherein the hand or foot includes digits and each digit includes a nail, during a UV light curing manicure or pedicure, comprising: a planar sheet having an upper surface, a lower surface and a peripheral edge, the planar sheet being composed of a material including a composition preventing ultraviolet light rays from traveling through the planar sheet; the planar sheet including a distal section having a plurality of slits formed therein and a proximal section with a single slit formed therein, each of the plurality of slits extending through the upper surface and the lower surface of the planar sheet and spaced away from the peripheral edge of the planar sheet; and each of the plurality of slits having a length and width to expand about the user's digits to expose the nails of the user's digits when attaching the planar sheet to the user's hand or foot so as to cover the hand or foot while exposing only the nails of the user's digits.

11. The shield in accordance with claim 10, wherein the plurality of slits in the distal section includes five slits in an arcuate pattern across the distal section of the planar sheet.

12. The shield in accordance with claim 11, wherein the single slit in the proximal section continues the arcuate pattern of the five slits of the distal section.

13. The shield in accordance with claim 10, wherein the plurality of slits in the distal section each have a longitudinal axis and the longitudinal axes of the plurality of slits are parallel to one another, and the single slit in the proximal section includes a longitudinal axis that is oblique relative to the longitudinal axes of the plurality of slits in the distal section.

14. The shield in accordance with claim 10, wherein the composition is titanium dioxide.

* * * * *

UNITED STATES PATENT AND TRADEMARK OFFICE

CERTIFICATE OF CORRECTION

PATENT NO. : 9,345,277 B2
APPLICATION NO. : 14/049520
DATED : May 24, 2016
INVENTOR(S) : Renee Albera It is certified that error appears in the above-identified patent and that said Letters Patent is hereby corrected as shown below:

In the Claims

Column 8, line 56, cancel the text beginning with "1. A shield for" to and ending "the user's digits." in Column 9, line 4, and insert the following claim:

--1. A shield for protecting a user's hand or foot, wherein the hand or foot includes digits and each digit includes a nail, during a UV light curing manicure or pedicure, comprising:

a planar sheet having an upper surface, a lower surface and a peripheral edge, the planar sheet being composed of an elastic material including a composition preventing ultraviolet light rays from traveling through the planar sheet;

the planar sheet including a plurality of slits formed in the planar sheet, each of the plurality of slits extending through the upper surface and the lower surface of the planar sheet and spaced away from the peripheral edge of the planar sheet; and each of the plurality of slits having a length and width to elastically stretch about the user's digits to expose the nails of the user's digits when attaching the planar sheet to the user's hand or foot so as to cover the hand or foot while exposing only the nails of the user's digits.--

Signed and Sealed this
Second Day of August, 2016

Michelle K. Lee

Michelle K. Lee
*Director of the United States Patent and Trademark Office*